US006669065B1

(12) United States Patent
Bradley et al.

(10) Patent No.: US 6,669,065 B1
(45) Date of Patent: Dec. 30, 2003

(54) GOLF TEE HOLDER AND DISPENSER

(76) Inventors: Christopher Bradley, 1900 Crest Ave., Suite 108, Juneau, AK (US) 99801; Timothy Bradley, 1900 Crest Ave #108, Juneau, AK (US) 99801; Thomas Knightlinger, 2525 Industrial Blvd., Suite B, Juneau, AK (US) 99801

( * ) Notice: Subject to any disclaimer, the term of this patent is extended or adjusted under 35 U.S.C. 154(b) by 34 days.

(21) Appl. No.: 10/186,120

(22) Filed: Jun. 28, 2002

(51) Int. Cl.[7] ..... B65D 83/00; B65G 59/00

(52) U.S. Cl. ..... 224/196; 224/269; 224/918; 206/315.1; 221/185; 221/309; 221/310

(58) Field of Search ..... 224/196, 666, 224/669, 269, 918; 206/315.1; 221/185, 309, 310, 251, 289

(56) References Cited

U.S. PATENT DOCUMENTS 1,739,780 A * 12/1929 Buhrke ..... 221/281
3,800,981 A * 4/1974 Zeller ..... 221/198
3,840,149 A * 10/1974 Zeller ..... 221/199
4,889,260 A * 12/1989 Zeller ..... 221/197
5,439,135 A * 8/1995 Schrader et al. ..... 221/251
6,000,589 A * 12/1999 Burdine ..... 224/196

* cited by examiner

*Primary Examiner*—Stephen K. Cronin
(74) *Attorney, Agent, or Firm*—Michael Tavella

(57) ABSTRACT

A holder for golf tees that has a housing with an open interior. The interior has two curved ends and a thin middle section that forms a "dumb bell" shape. A plate that has a matching dumb bell is fitted into the open interior. Two springs are mounted inside of the housing and are attached to the bottom of the housing and to the bottom of the plate. A retainer pin is placed orthogonally across the top opening of the housing. The pin retains the plate in the housing and secures any tees that are installed as well. Tees are placed into the housing by sliding the pointed end under the retainer pin and pushing down on the plate. To dispense a tee, a user pushes down slightly on the pointed end of the top tee, which raises the other end of that it can be pulled from the holder.

19 Claims, 9 Drawing Sheets

GOLF TEE HOLDER AND DISPENSER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to golf tee holders and particularly to golf tee holders that dispense golf tees.

2. Description of the Prior Art

Golf is an ever-growing sport. Today millions of people play golf on thousands of courses around the world. Besides fees for playing golf, millions of dollars are spent every year on equipment. The are almost countless accessories one can buy that cover almost all aspects of the game.

One of the most used accessories is a golf tee. These are typically made of wood or plastic. The have a small curved top that holds a ball and a pointed shaft that enables a golfer to set the tee in the ground. Tees vary in length from about 1¾ inches (42 mm) to 2½ inches (60 mm). Players typically keep a number of tees in their golf bags and may carry two or three in their pockets as the game is played. As tees are used, players must go to their golf bags to retrieve more tees. Often this means digging around in the bottom of a golf bag pocket. This not only takes time, but can be distracting as well.

BRIEF DESCRIPTION OF THE INVENTION

The instant invention eliminates the need to have to search for loose tees in golf bags. It is a housing that has an open interior. The interior has two curved ends and a thin middle section, which forms a "dumb bell" shape. A plate that has a matching dumb bell is fitted into the open interior. In the preferred embodiment, two springs are mounted inside of the housing. The plate sits on the springs and "floats" in the housing, resting on the two springs. A retainer pin is placed orthogonally across the top opening of the housing. The pin retains the plate in the housing and secures any tees that are installed as well.

Tees are placed into the housing by sliding the pointed end under the retainer pin and pushing down on the plate. The curved top of the tees fits into the curved portion of the housing interior. The next tee is placed in the housing from the opposite end. In this way, tees are loaded from alternate ends of the housing until the housing is full.

To dispense a tee, a user pushes down slightly on the pointed end of the top tee. This raises the curved portion enough for the user to then pull the tee out of the housing. The springs under the plate automatically push the plate and the remaining tees upward so that the next tee is in a position to be dispensed.

In an alternative embodiment, a folding type scissors spring can be used, however this is not preferred.

The tee carrier can be carried in a pocket or on a belt, or on the side of a golf bag. In this way, a ready supply of tees is available use, being dispensed quickly and easily.

DETAILED DESCRIPTION OF THE INVENTION

Figure 1:
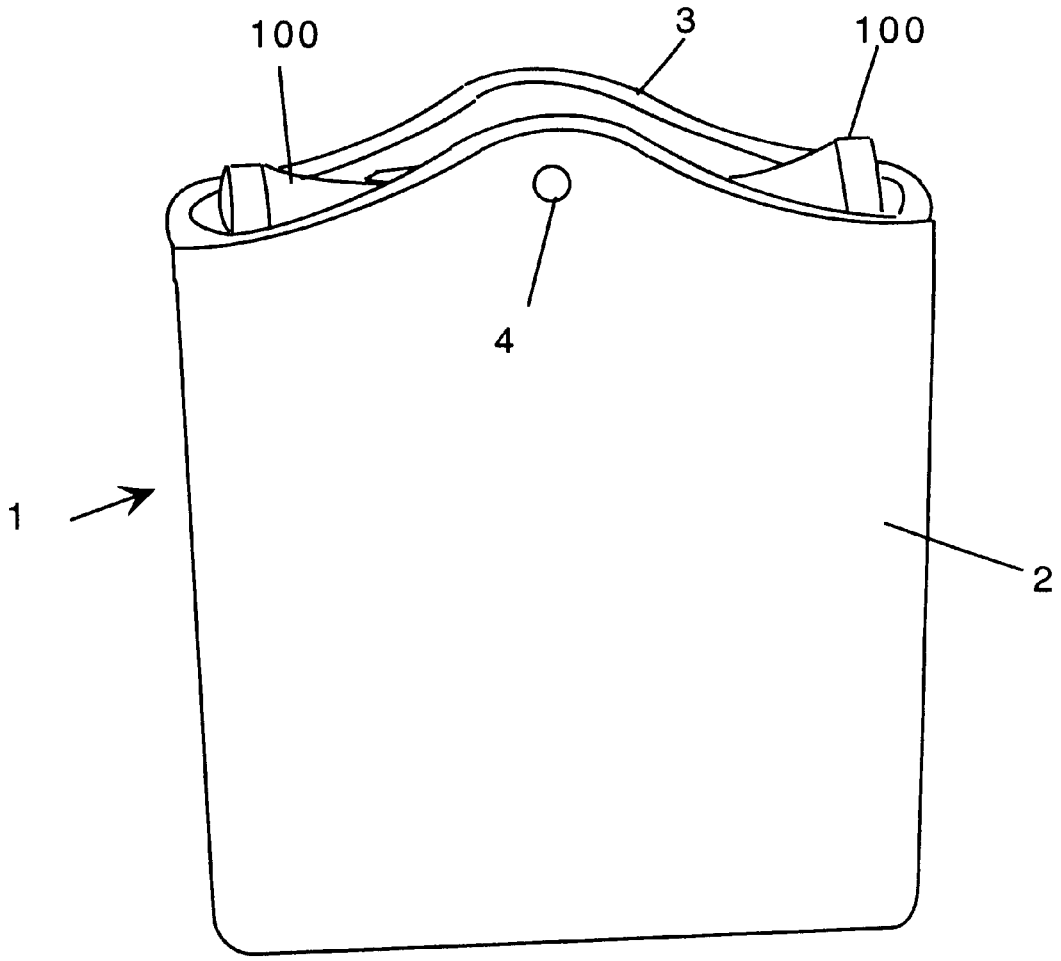
FIG. 1 is a front perspective view of the invention loaded with golf tees.
Figure 2:
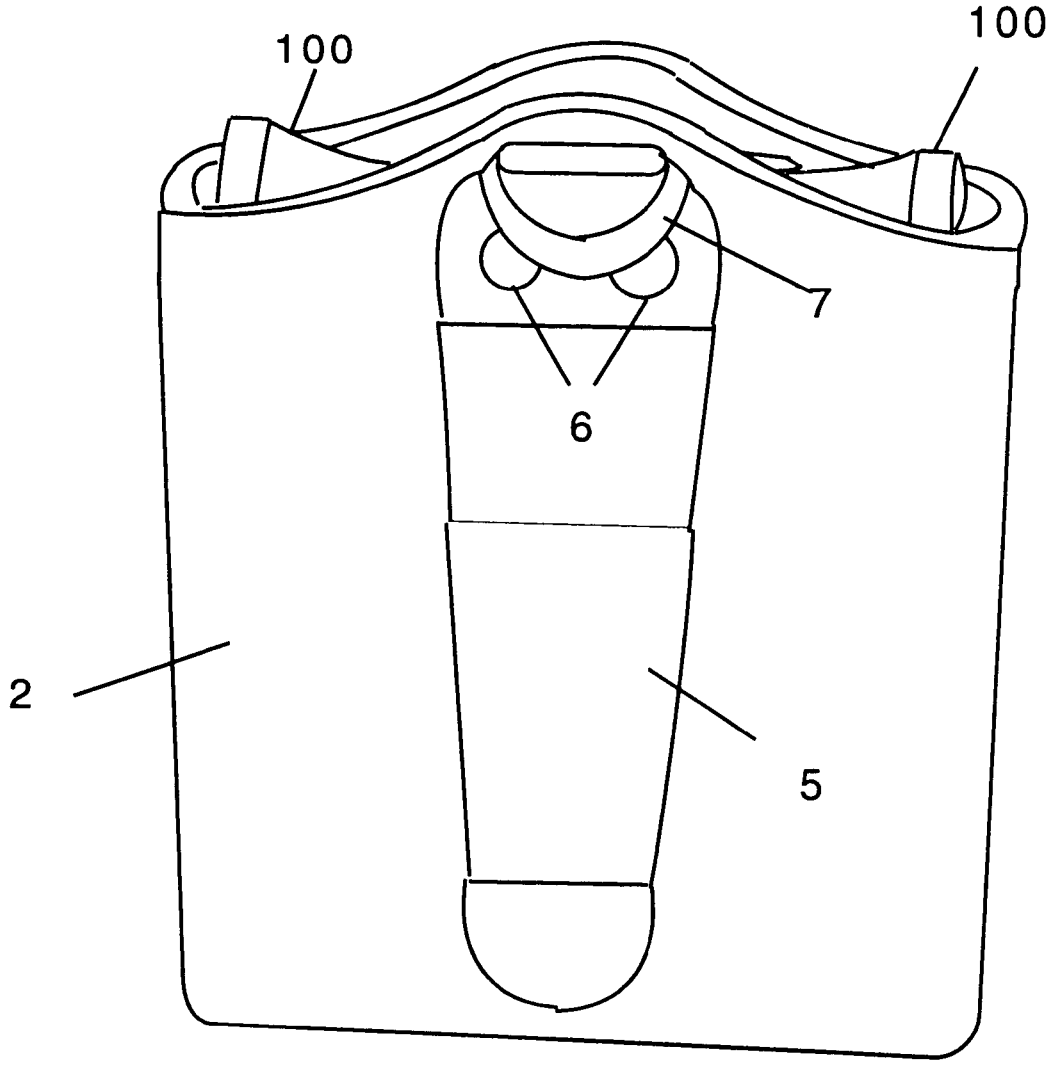
FIG. 2 is a rear perspective view of the invention loaded with golf tees.

Referring now to FIGS. 1 and 2, the invention 1 has a housing 2 that holds a number of golf tees 100. The housing 2 has a generally rectangular body and a curved top 3. The curved top is designed to hold a restraining pin 4, which is discussed in detail below. FIG. 2 shows the back of the housing 2. In the preferred embodiment, a belt clip 5 attached as shown. Of course, any style of belt clip can be used. In the figure the clip is secured to the housing by fasteners 6. However, the clip can be molded into a one-piece plastic unit, or can be attached using any means common to the art. FIG. 2 also shows an attachment ring 7 that can be used to clip the housing to a golf bag, for example. Again, this ring is part of the preferred embodiment and is not essential to the operation of the device.

Figure 3:
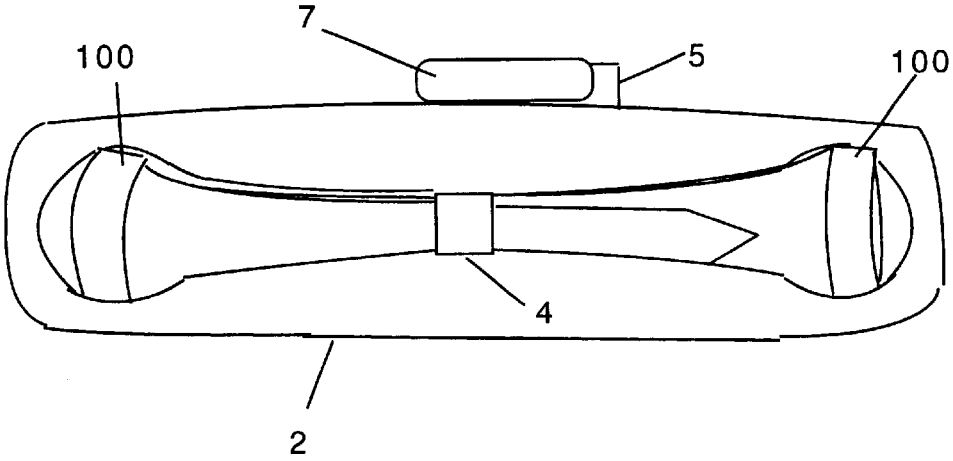
FIG. 3 is a top view of the invention loaded with golf tees.

FIG. 3 shows a top view of the invention. Here two tees 100 are in place in the housing. The tees are secured by the restraining pin 4, which is installed between the front and rear of the housing.

Figure 4:
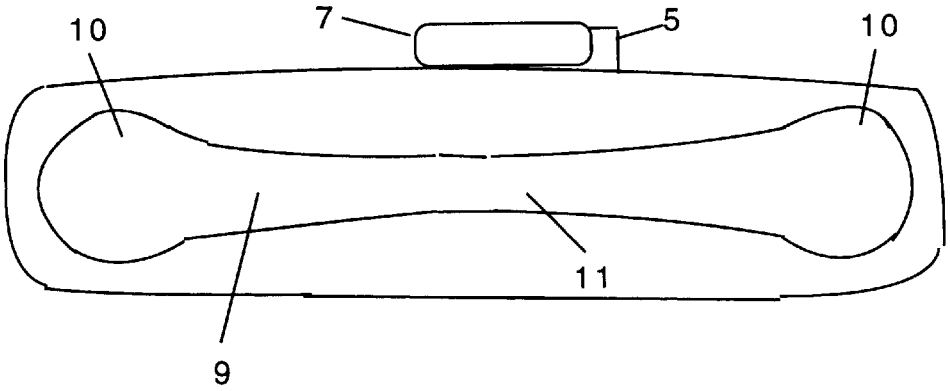
FIG. 4 is a top view of the housing without the springs or holding plate in place.
Figure 5:
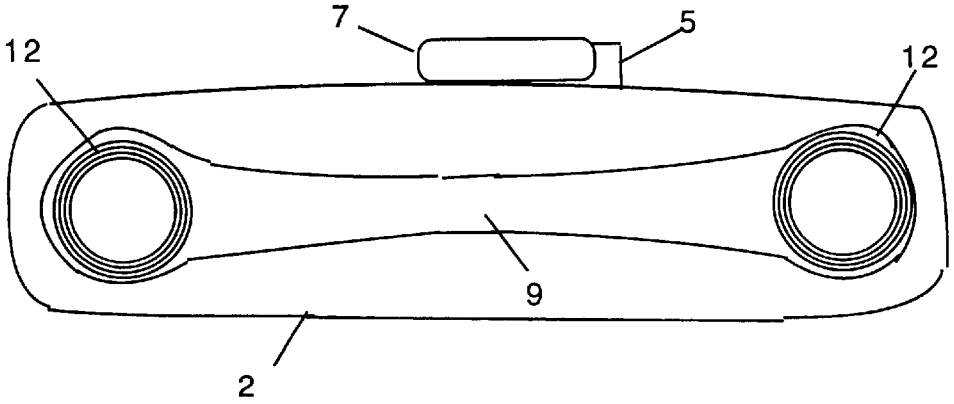
FIG. 5 is a top view of the housing showing the springs in place.

FIG. 4 shows a top view of the housing 2 without any other components installed. The housing is made of a formed piece. It can be wood, plastic, or any other similar material; however the preferred embodiment is made of molded plastic. The inside of the housing has a dumbbell-shaped area 9 that is routed or formed in a mold as part of the manufacturing process. The ends 10 of the area are circular as shown. The thin rectangular area 11 connects these ends 10. As shown in FIG. 5, two springs 12 are placed in the circular areas. In the preferred embodiment, the springs 12 are coil type springs. The circular areas 10 are shaped not only to hold the springs 12, but also act to hold the larger tops of the tees (see FIG. 3). The springs 12 are placed in the housing, but are not attached to the bottom of the housing 2 (although they could be if desired).

Figure 6:
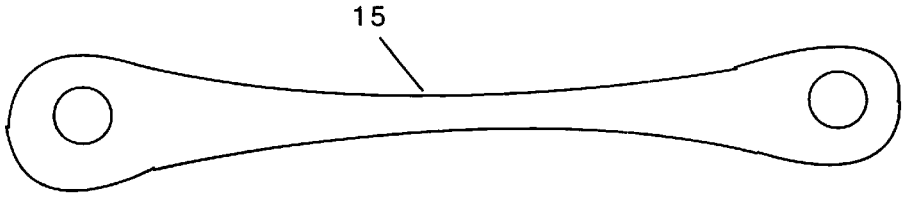
FIG. 6 is a top view of the holding plate.
Figure 7:
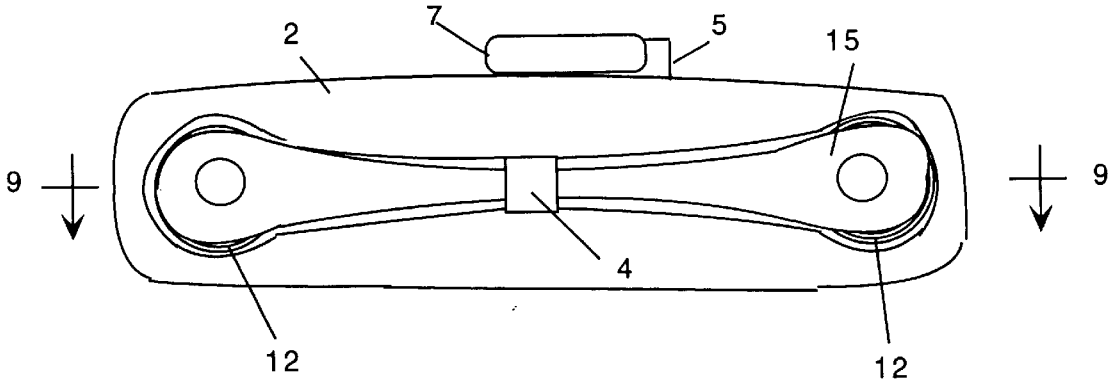
FIG. 7 is a top view of the invention fully assembled with no tees installed.

FIG. 6 shows a top view of a retainer plate 15. The retainer plate 15 has a similar dumbbell shape, but is made smaller to fit within the dumbbell shaped area of the housing. The retainer plate 15 sits on the top of the springs 12, as shown in FIG. 7. Note that it is not attached to the springs, although it could be attached if desired.

Figure 8:
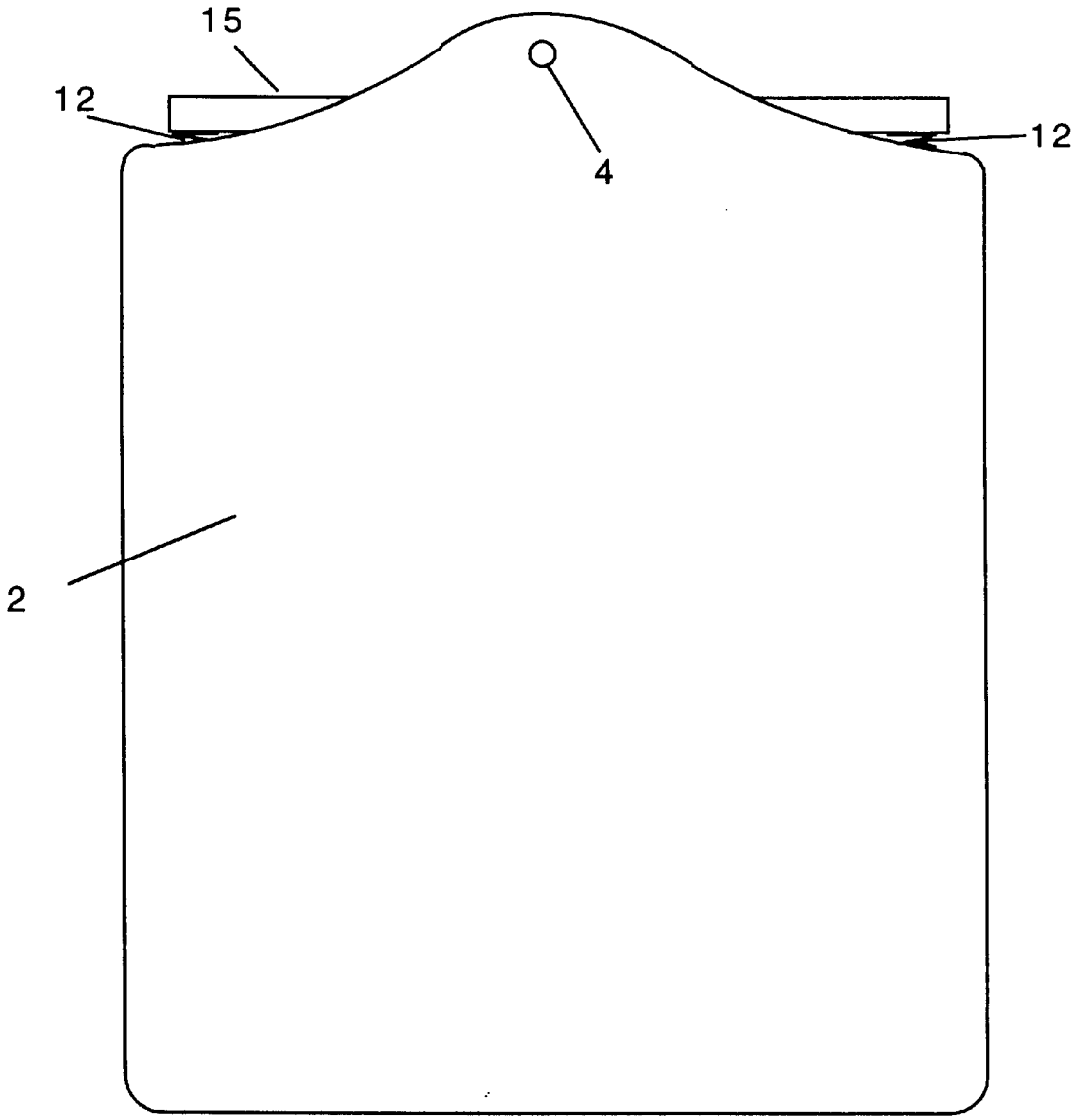
FIG. 8 is a front view of the invention with no tees installed.
Figure 9:
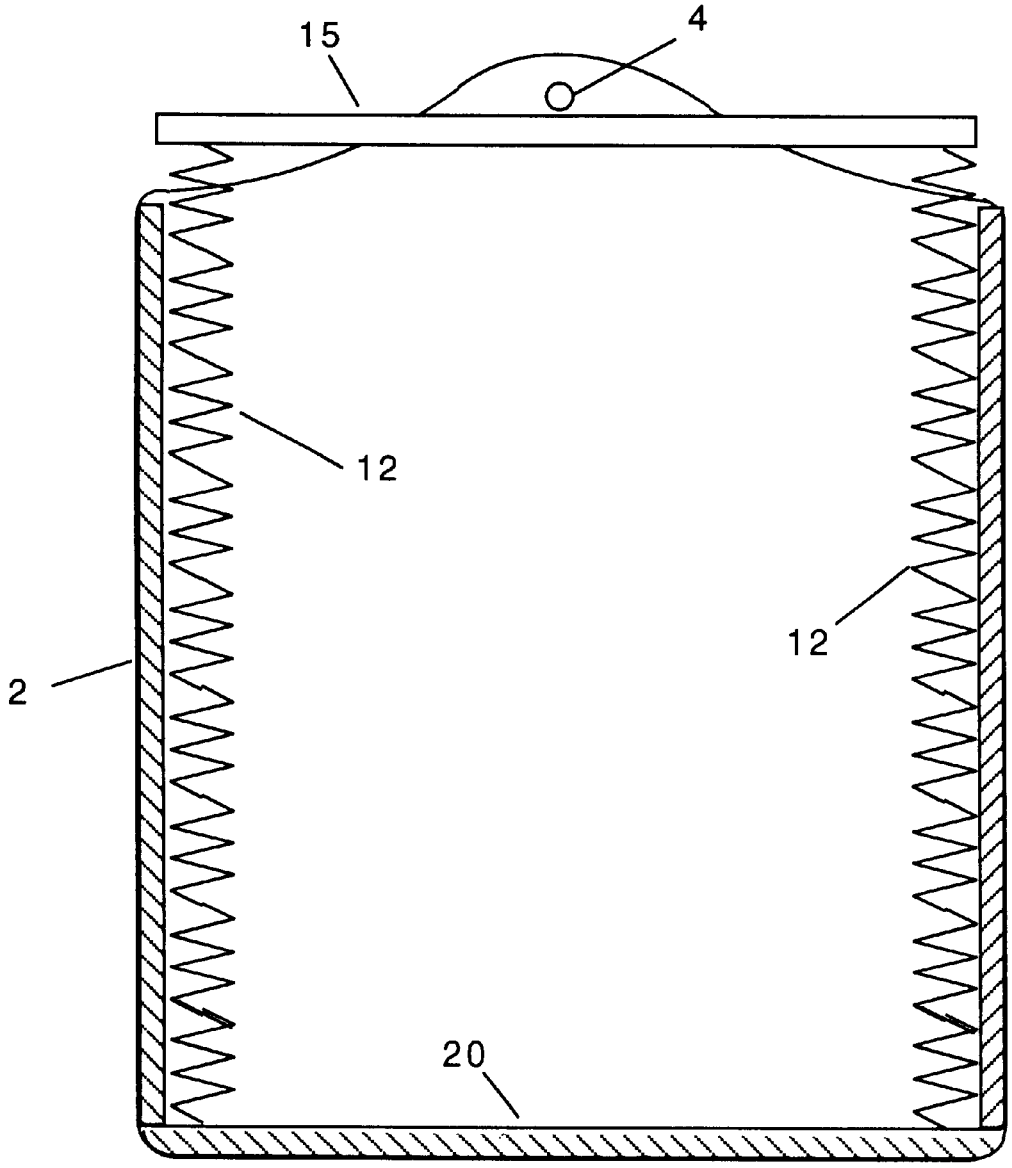
FIG. 9 is a cross-sectional view of the invention taken along the lines 9—9 of FIG. 7.

FIG. 8 is a front view of the housing 2 showing the retainer plate 15 sitting atop the springs 12. When the invention is not loaded. The retainer plate 15 rests against, and is held in place by the retainer pin 4. This is shown in detail in FIG. 9. FIG. 9 is a cross-sectional view of the housing showing the placement of the springs 12 in the housing 2. It also shows the action of the retainer pin 4 as it holds the retainer plate 15 and the springs 12 in place.

Figure 10:
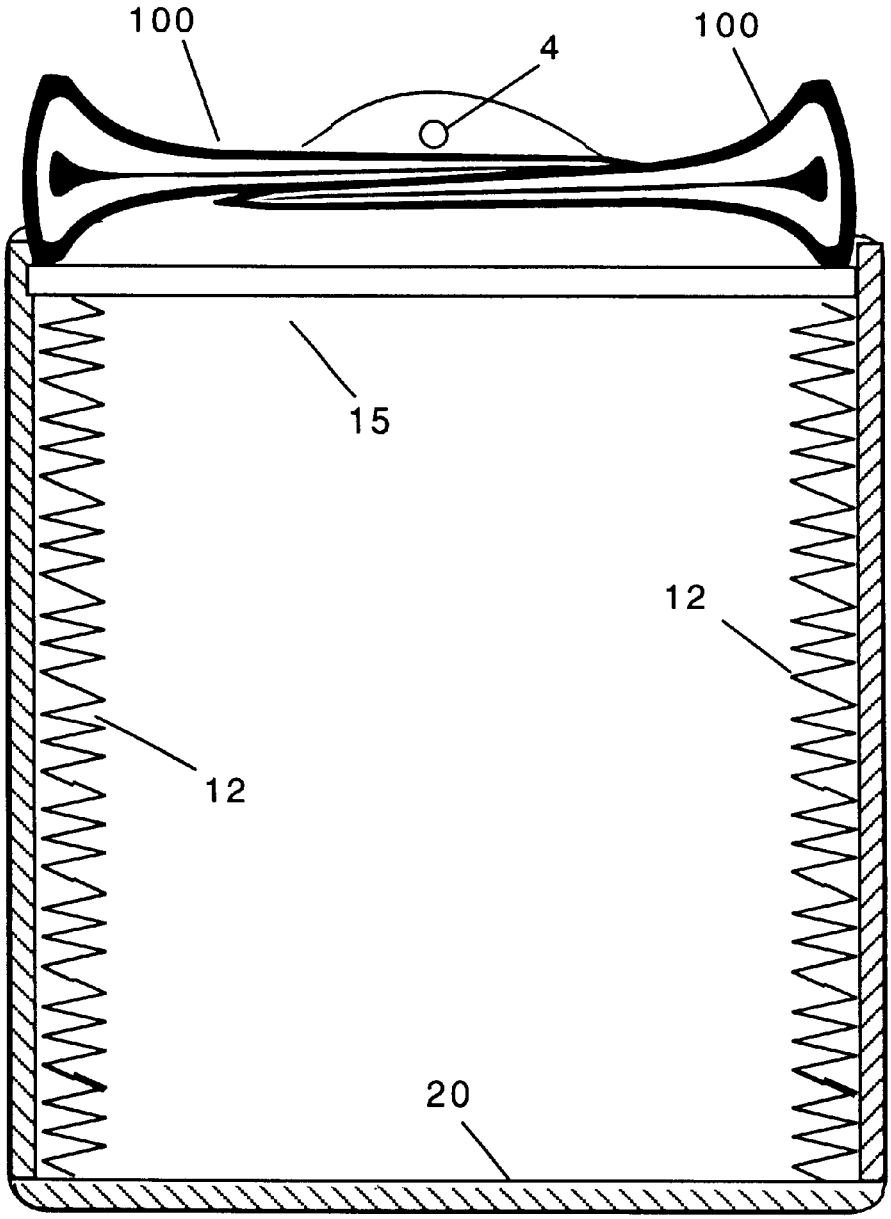
FIG. 10 is the cross-sectional view of FIG. 9 showing two tees installed.

FIG. 10 shows a cross-section of the device with two tees 100 in place. When loaded, the tees 100 push the retainer plate 15 down, compressing the springs 12. In the preferred embodiment, 10 tees can be easily carried in the device. Of course, the device can be made larger, but then its size becomes a liability as it becomes too cumbersome to carry.

Figure 11:
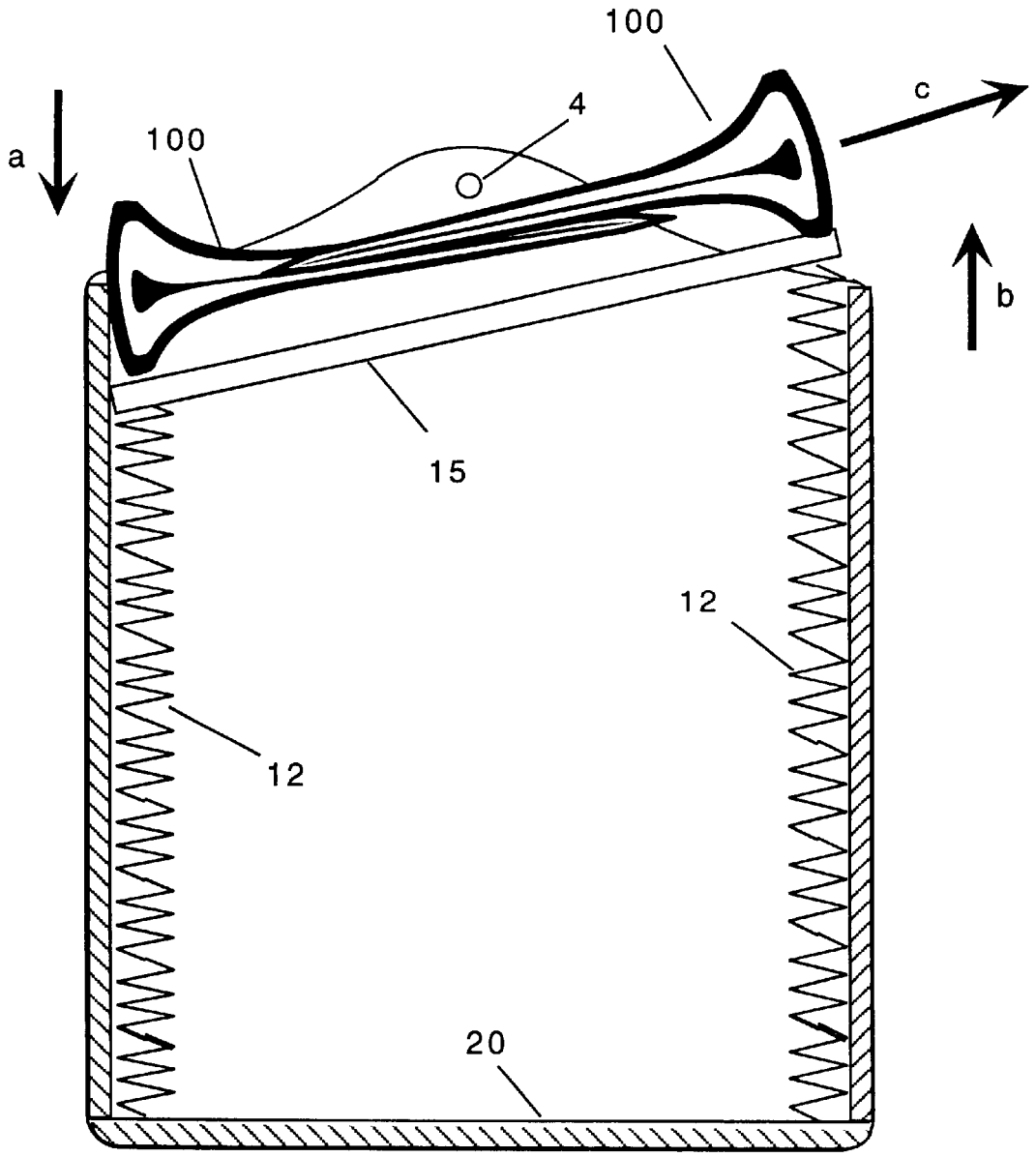
FIG. 11 is a cross-sectional detail view of the invention as a tee is being dispensed.

FIG. 11 is a detail showing how a tee 100 is dispensed. First, a user pushes down on one side of retainer bar (by pushing on a tee). This is shown by arrow a. This action causes the retainer plate 15 to pivot around the retainer pin 4, which causes the other end to rise in the direction of arrow b. Once the top of the tee 100 has surpassed the top of the housing side wall, it can be easily pulled out in the direction of arrow c. At this point, the other side of the retainer bar can be released and the tees level off to the position shown in FIG. 10. Note that to load the housing, the opposite method is used. The pointed end of a tee is slid under the retainer pin, depressing the retainer plate. This action is continued until the tee passes over the side wall of the housing. The next tee is inserted in the same manner, only from the opposite side. This action is repeated until the housing is full.

Figure 12:
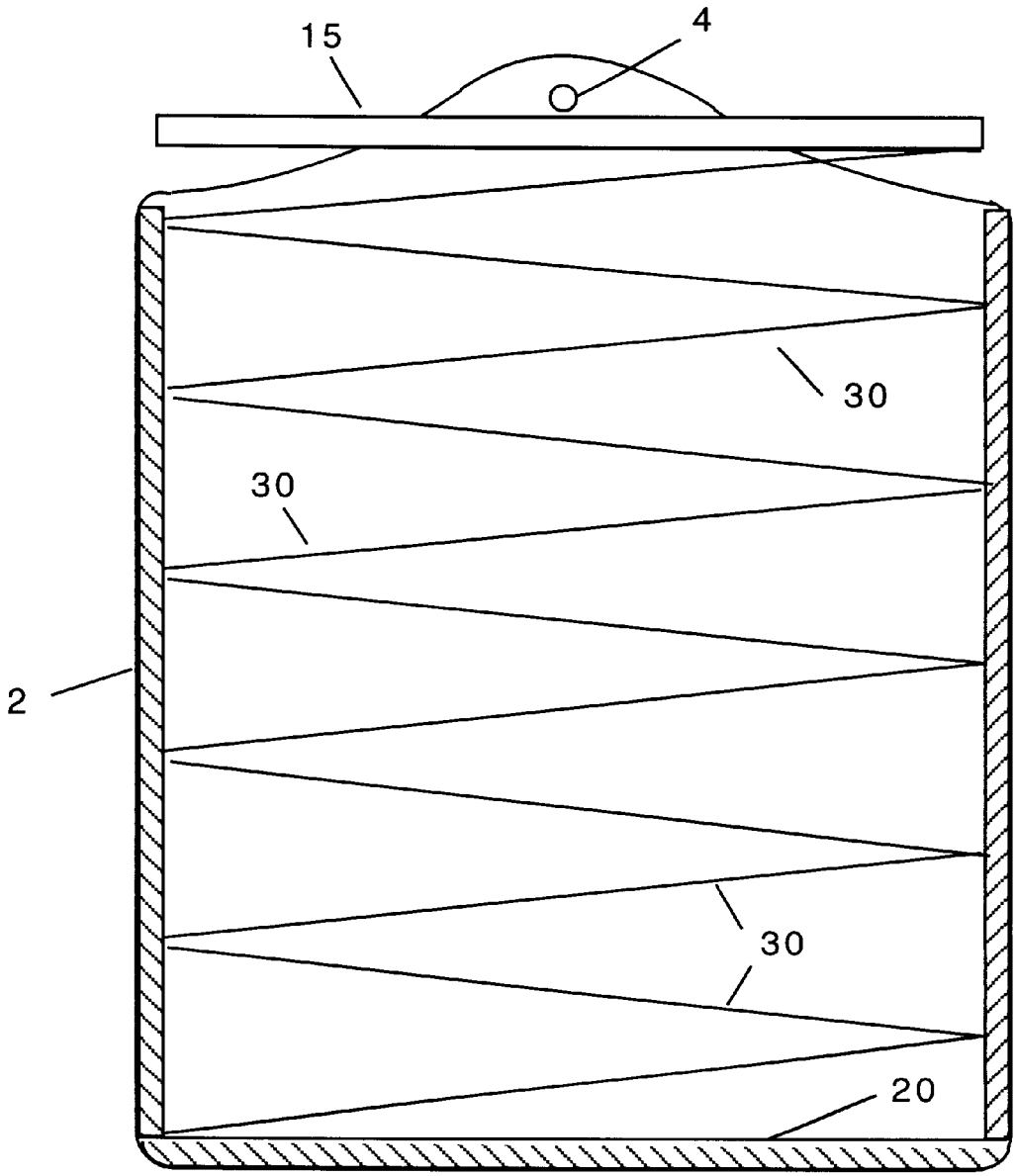
FIG. 12 is a cross-sectional view of the invention showing an alternate type spring.

Finally, FIG. 12 is a detail of an alternative embodiment. This embodiment is identical to that above except that instead of the two coil springs 12, a single scissors spring 30 is used. This spring is similar to that used in rifle clips. Although this type of spring can be used, it is not preferred. In rifle clips, shells are loaded and discharged from one side only. This action works well with such springs. Here, the golf tees are dispensed from both sides of the holder. While a scissors type spring works, it is not as efficient or as good as the two-spring design in the preferred embodiment.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A holder for golf tees comprising:

a) a housing, said housing having an open top, a hollow core and a solid bottom having two ends;

b) a spring, placed in said housing a resting on said solid bottom and extending upwardly therefrom;

c) a rocker arm, said rocker arm having two ends and being sized to fit within said hollow core of said housing, said rocker arm being placed on said spring; and d) a means for retaining said rocker arm in said housing.

2. The holder for golf tees of claim 1 wherein the means for retaining said rocker arm causes said rocker arm to maintain a bias on said spring.

3. The holder for golf tees of claim 1 wherein said rocker arm pivots about said means for retaining said rocker arm.

4. The holder for golf tees of claim 1 wherein said means for retaining said rocker arm comprises a pin, placed in said open top of said housing orthogonal to said rocker arm.

5. The holder for golf tees of claim 1 further comprising a belt clip secured to said housing.

6. The holder for golf tees of claim 1 wherein said rocker arm has a dumbbell shape.

7. The holder for golf tees of claim 1 wherein said hollow core forms a dumbbell shaped opening.

8. A holder for golf tees comprising:

a) a housing, said housing having an open top, a hollow core, a front and a back, and a solid bottom having two ends;

b) a first spring, positioned in said housing and extending upwardly from one end of said solid bottom;

c) a second spring, positioned in said housing and extending upwardly from the second end of said solid bottom;

d) a rocker arm, said rocker arm having two ends and being sized to fit within said hollow core of said housing, one end of said rocker arm resting in said first spring and the other end of said rocker arm resting on said second spring; and e) a means for retaining said rocker arm in said housing.

9. The holder for golf tees of claim 8 wherein the means for retaining said rocker arm in said housing comprises a pin, fixedly installed in said front and back of said housing such that said pin lies orthogonal to said hollow core, said pin being used hold said rocker arm within said hollow core of said housing.

10. The holder for golf tees of claim 9 wherein said rocker arm pivots about said pin.

11. The holder for golf tees of claim 8 wherein the rocker arm maintains a bias on said first and second springs.

12. The holder for golf tees of claim 8 further comprising a belt clip secured to said housing.

13. The holder for golf tees of claim 8 wherein said rocker arm has a dumbbell shape.

14. The holder for golf tees of claim 8 wherein said hollow core forms a dumbbell shaped opening.

15. A holder for golf tees comprising:

a) a housing, said housing having an open top, a front wall, a back wall, a solid bottom having two ends, and a hollow core, said hollow inner core having a first rounded end, a second rounded end and a elongated rectangular portion therebetween and further wherein said front wall and said back wall each having a center arch formed thereon extending upward therefrom;

b) a first spring, positioned in said housing and resting on said solid bottom and extending upwardly therefrom;

c) a second spring, positioned in said housing and resting on said solid bottom and extending upwardly therefrom;

d) a rocker arm, said rocker arm having two rounded ends and being sized to fit within said hollow core of said housing, one end of said rocker arm resting on said first spring and the other end of said rocker arm resting on said second spring; and e) a pin, fixedly installed in said center arch of said front and back walls of said housing such that said pin lies orthogonal to said hollow core, and lying just above said open top of said housing said pin being used hold said rocker arm within said hollow core of said housing.

16. The holder for golf tees of claim 15 wherein the means for retaining said rocker arm maintains a bias on said first and second springs.

17. The holder for golf tees of claim 15 wherein said rocker arm pivots about said pin.

18. The holder for golf tees of claim 15 further comprising a belt clip secured to said housing.

19. The holder for golf tees of claim 15 wherein said first and second springs are coil springs.

* * * * *